US006739082B2

(12) United States Patent
Christensen

(10) Patent No.: US 6,739,082 B2
(45) Date of Patent: May 25, 2004

(54) FIREARM WITH FIXED CARTRIDGE MAGAZINE TOP

(75) Inventor: Craig A. Christensen, Yuba City, CA (US)

(73) Assignee: Shoeless Ventures, Inc., Dayton, NV (US)

( * ) Notice: Subject to any disclaimer, the term of this patent is extended or adjusted under 35 U.S.C. 154(b) by 0 days.

(21) Appl. No.: 10/358,418

(22) Filed: Feb. 4, 2003

(65) Prior Publication Data

US 2004/0020092 A1 Feb. 5, 2004

Related U.S. Application Data

(60) Provisional application No. 60/354,201, filed on Feb. 4, 2002.

(51) Int. Cl.[7] ..... F41A 9/61

(52) U.S. Cl. ..... 42/6; 42/49.02; 42/75.04; 89/33.1

(58) Field of Search ..... 42/6, 8, 49.01, 42/49.02, 75.04, 17; 89/33.1, 33.01

(56) References Cited

U.S. PATENT DOCUMENTS

| | | | | | |
|---|---|---|---|---|---|
| 513,647 | A | | 1/1894 | Lee | |
| 2,655,753 | A | * | 10/1953 | Salas | 42/50 |
| 3,390,476 | A | * | 7/1968 | Vervier | 42/50 |
| 3,574,264 | A | * | 4/1971 | Simmons, Sr. | 42/6 |
| 3,676,946 | A | | 7/1972 | Sibilia | 42/50 |
| 3,803,739 | A | * | 4/1974 | Haines et al. | 42/6 |
| 4,226,041 | A | | 10/1980 | Goodworth | 42/50 |
| 4,314,419 | A | | 2/1982 | Koon, Jr. | 42/50 |
| 4,408,409 | A | | 10/1983 | Arias L. | 42/50 |
| 4,527,459 | A | * | 7/1985 | Childers | 89/161 |
| 4,677,781 | A | | 7/1987 | Lee | 42/70.01 |
| 5,452,534 | A | * | 9/1995 | Lambie | 42/18 |
| 5,519,954 | A | * | 5/1996 | Garrett | 42/6 |
| 5,685,101 | A | | 11/1997 | Ferretti | 42/18 |
| 5,806,224 | A | * | 9/1998 | Hager | 42/18 |
| 5,845,426 | A | | 12/1998 | Valorose | 42/49.02 |
| 6,164,000 | A | | 12/2000 | Lumplecker et al. | 42/6 |
| 6,212,814 | B1 | | 4/2001 | Lambie | 42/75.03 |

* cited by examiner

*Primary Examiner*—Michael J. Carone
*Assistant Examiner*—Gabriel S. Sukman
(74) *Attorney, Agent, or Firm*—Harrington & Smith, LLP

(57) ABSTRACT

A firearm including a barrel, an upper receiver, a lower receiver, a cartridge magazine top, a magazine follower, and a magazine spring. The upper receiver has the barrel attached thereto. The lower receiver is pivotably attached to the upper receiver. The lower receiver comprises a one piece frame member forming a magazine well with an integral substantially closed bottom end. The magazine top is stationarily attached to the lower receiver. The magazine top comprises inward projecting rear cartridge retaining ears and front cartridge feeding lips at a top aperture through the magazine top. The magazine follower is movably located in the magazine well of the lower receiver. The spring is located between the closed bottom end of the magazine well and the magazine follower.

28 Claims, 8 Drawing Sheets

FIREARM WITH FIXED CARTRIDGE MAGAZINE TOP

CROSS REFERENCE TO RELATED APPLICATION

This application claims the benefit under 35 U.S.C. 119(e) of U.S. provisional patent application No. 60/354,201 filed Feb. 4, 2002.

BACKGROUND OF THE INVENTION

1. Field of the Invention

The present invention relates to firearms and, more particularly, to a firearm having a fixed cartridge magazine top.

2. Brief Description of Prior Developments

By way of background, certain assault weapons have been outlawed in the United States. A key feature in illegal-assault weapons is the presence of a magazine clip that has a very large capacity. More specifically, with the enactment on Sep. 13, 1994 of the Violent Crime Control and Law Enforcement Act of 1994, magazines for pistols were restricted to ten rounds or less, other than those manufactured for law enforcement agencies and for government use. Pursuant to that legislation, magazines for civilian use were restricted in capacity to ten rounds or less and were required to be manufactured by stamping process. This historical information is set forth in U.S. Pat. No. 5,845,426, which is incorporated herein by reference.

The Violent Crime Control and Law Enforcement Act of 1994 is also referred to The Crime Bill. The Crime Bill labels firearms as "assault weapons" by two methods: name and description. All told, the ban affects more than 175 semi-automatic rifles, pistols and shotguns and revolving cylinder shotguns—a cross section of firearms of various sizes, shapes, and calibers/gauges. The Crime Bill recites broadly that any semi-automatic rifle or handgun is banned which includes a detachable magazine plus a number of other factors. This addition historical information is set forth in U.S. Pat. No. 5,806,224, which is also incorporated herein by reference.

The same laws that ban illegal assault weapons also provide that if suitable major modifications are made to the assault weapon, the then modified assault weapon can become legal. One type of firearm design which has been commercially available for general civilian retail sales has used an M-16 style of upper and lower receiver configuration. This has included firearms such as the COLT AR-15®, COLT SPORTER®, the COLT MATCH TARGET®, and the Bushmaster XM-15, for example. Some purchasers of rifles prefer the M-16 style of upper and lower receiver configuration because of many factors, such as familiarity with the weapon from prior military service, and/or relative ease for obtaining service and replacement parts because of the firearm configuration's popularity.

There is a desire to provide a firearm having an M-16 style configuration which does not use a removable magazine. Preferably, such a firearm will comprise an internal magazine which is adapted to contain ten cartridges or less. There is also a desire to provide a firearm having an M-16 style configuration which is required to undergo a partial disassembly to load new cartridges into the cartridge magazine. There is also a desire to provide a firearm having an M-16 style configuration which requires cartridges to be loaded into an internal cartridge magazine in a direction from a top of the firearm. As used herein, the term "M-16 style configuration" is intended to mean a gas operated or blowback operated firearm which has an upper receiver and a lower receiver connected to each other by a front hinge and a rear takedown pin, and a reciprocating bolt carrier and bolt.

SUMMARY OF THE INVENTION

A magazine receiver apparatus is provided for a firearm that has a firearm firing unit, and the magazine receiver apparatus includes a magazine receiver housing which includes first housing-to-firing-unit connector means, second housing-to-firing-unit connector means, and a magazine well which includes a spring reception recess. The magazine receiver housing further includes a set screw reception channel in a wall of the magazine well, and further includes a magazine housing set screw received in the set screw reception channel.

A spring-loaded assembly is received in the magazine well and the spring reception recess. The spring-loaded magazine assembly includes a magazine housing push-up spring received in the spring reception recess. A magazine housing follower is pushed up by the magazine housing push-up spring, and cartridges contained in the magazine housing are pushed up by the magazine housing follower. The magazine housing has a maximum capacity of ten cartridges.

The magazine housing includes a set screw reception well for receiving the magazine housing set screw for securing the spring-loaded magazine assembly in the magazine well.

Preferably, the first housing-to-firing-unit connector means include a first hinge portion formed in the magazine receiver housing, a second hinge portion formed in the firearm firing unit, and a hinge pin received in the first hinge portion and the second hinge portion to form a hinged connection between the firearm firing unit and the magazine receiver apparatus. The first. hinge portion includes a front pivot pin reception channel.

Preferably, the second housing-to-firing unit connector means includes a first takedown pin reception channel in the magazine receiver housing, a second takedown pin reception channel in the firearm firing unit, and takedown pin received in the first takedown pin reception channel and the second takedown pin reception channel for securing the magazine receiver housing to the firearm firing unit. Preferably, the magazine receiver housing includes a pin advancement well surrounding on end of the first takedown pin reception channel.

The magazine receiver housing further includes a stock-connector portion for connecting to a firearm stock. Also, the magazine receiver housing further includes a grip-connector portion for connection to a firearm pistol grip.

Preferably, the magazine receiver ho using further includes a self-contained takedown-pin-detent assembly for retaining the takedown pin in the magazine receiver housing.

Preferably, the takedown-pin-detent assembly includes a takedown pin detent assembly reception channel extending from outside the magazine receiver housing to the first takedown pin reception channel. A takedown pin detent set screw reception channel portion is formed as part of the first takedown pin reception channel, distal from the first takedown pin reception channel. A takedown pin detent ball is located in the takedown pin detent assembly reception channel adjacent to the first takedown pin reception channel. A takedown pin detent ball is located inside the takedown pin detent assembly reception channel adjacent to the first takedown pin reception channel. A takedown pin detent spring is located in the takedown pin detent assembly reception channel adjacent to the takedown pin detent ball. A takedown pin detent set screw is received in the takedown pin detent set screw reception channel portion adjacent to the takedown pin detent spring.

Preferably, the magazine receiver housing further includes a self-contained safety switch detent assembly for retaining a safety switch assembly in the magazine receiver housing. The safety switch detent assembly includes a safety switch detent assembly reception channel extending from outside the magazine receiver housing to contacted portion of a safety switch assembly. A safety detent assembly reception channel formed as part of the safety switch detent assembly reception channel, distal from the contacted portion of the safety switch assembly. A safety detent. ball located inside the safety switch detent assembly reception channel adjacent to the contacted portion of the safety switch assembly. A safety detent spring located in the safety switch detent assembly reception channel adjacent to the safety detent ball, and a safety detent set screw received in the safety detent assembly reception channel adjacent to the safety detent spring.

In accordance with one aspect of the present invention, a firearm is provided including a barrel, an upper receiver, a lower receiver, a cartridge magazine top, a magazine follower, and a magazine spring. The upper receiver has the barrel attached thereto. The lower receiver is pivotably attached to the upper receiver. The lower receiver comprises a one piece frame member forming a magazine well with an integral substantially closed bottom end. The magazine top is stationarily attached to the lower receiver. The magazine top comprises inward projecting rear cartridge retaining ears and front cartridge feeding lips at a top aperture through the magazine top. The magazine follower is movably located in the magazine well of the lower receiver. The spring is located between the closed bottom end of the magazine well and the magazine follower.

In accordance with another aspect of the present invention, a firearm subassembly is provided comprising a firearm receiver frame member having a magazine well; a magazine top fixedly attached to the firearm receiver frame member at a top of the magazine well; and a magazine follower and a magazine spring located in the magazine well below the magazine top. The magazine top comprises rear cartridge retaining ears at a top aperture through the magazine top. A bottom portion of the magazine top is located against an upwardly facing ledge inside a top portion of the magazine well.

In accordance with one method of the present invention, a method of manufacturing a firearm subassembly is provided comprising steps of forming a one-piece firearm lower receiver frame member by forging the frame member and machining the frame member to form a magazine well with a substantially closed bottom end, wherein the lower receiver frame member is sized and shaped to be pivotably connected to a firearm upper receiver; inserting a magazine spring and a magazine follower into the magazine well of the lower receiver frame member; and stationarily attaching a magazine top to the lower receiver frame member to at least partially cover a top cartridge entrance/exit to the magazine well at an upper side of the lower receiver frame member. The magazine top comprises rear cartridge retaining ears and front cartridge feeding lips. Cartridges can only be loaded into the magazine well of the lower receiver frame member by pressing the cartridges through the top of the magazine well at the upper side of the lower receiver frame member through the magazine top.

BRIEF DESCRIPTION OF THE DRAWINGS

The invention will be better understood and the above object as well as objects other than those set forth above will become more apparent after a study of the following detailed description thereof. Such description makes reference to the annexed drawing wherein.

DETAILED DESCRIPTION OF THE PREFERRED EMBODIMENT

Figure 1:
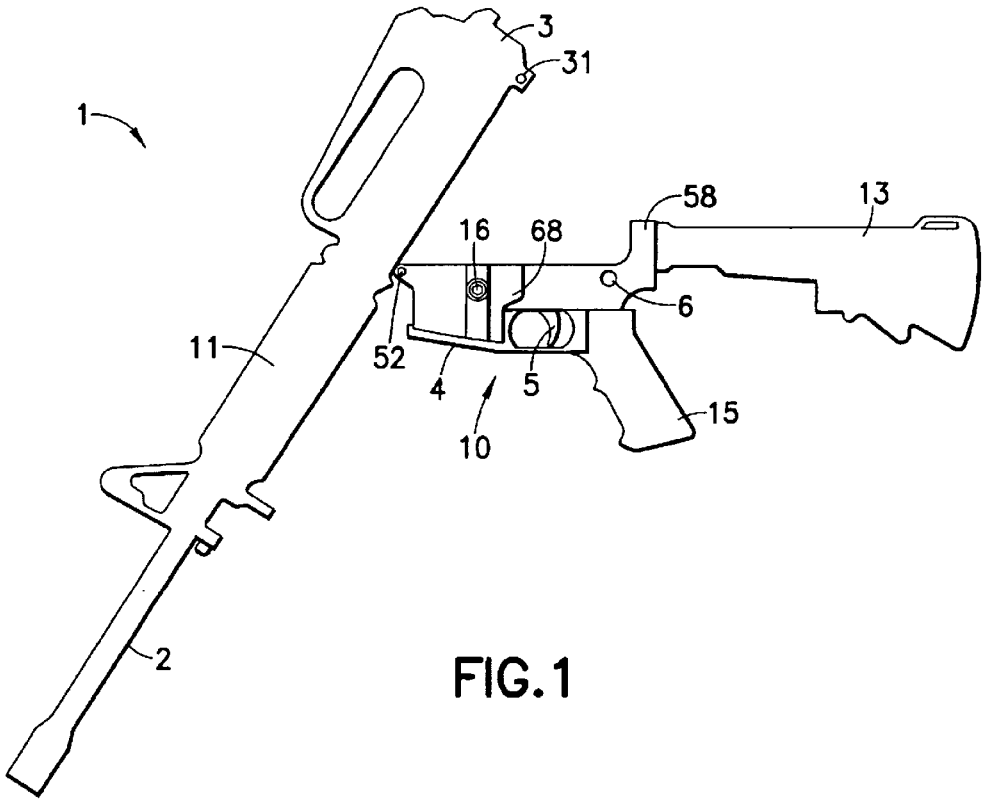
FIG. 1 is a side view showing a preferred embodiment of the firearm magazine receiver apparatus of the invention installed on a complete firearm, between a firing unit, a stock, and a pistol grip.

Referring to FIG. 1, there is shown a side view of a firearm 1 incorporating features of the present invention. Although the present invention will be described with reference to the exemplary embodiments shown in the drawings, it should be understood that the present invention can be embodied in many alternate forms of embodiments.

In addition, any suitable size, shape or type of elements or materials could be used.

The firearm 1 generally comprises a barrel 2, a frame comprising an upper receiver 3 and a lower receiver 4, a stock 13, a pistol grip 15, and a firing mechanism 5. The firing mechanism 5 is well known in the art. The upper receiver 3 is also well known in the art. The barrel 2 is fixedly attached to the upper receiver 3 to form unit 11 as is well known in the art. The upper receiver 3 is pivotably attached to the lower receiver 4 at a hinge pin 52. The firing mechanism includes a trigger and hammer assembly in the lower receiver, and a bolt carrier and bolt assembly longitudinally, slidably mounted in the upper receiver. The upper receiver 3 also comprises a takedown pin reception channel 31 for receiving a takedown pin attached to the lower receiver 4 as is well known in the art, to fixedly attach the upper receiver 3 to the lower receiver 4.

Referring also to FIGS. 2–7, the firearm 1 includes a firearm magazine receiving apparatus, generally designated by reference numeral 10, formed in the lower receiver 4. The magazine receiver apparatus 10 includes a lower receiver frame member 68 which forms a magazine receiver housing. The lower receiver frame member 68 includes first housing-to-firing-unit connector means at the hinge pin 52 (see FIG. 1), a second housing-to-firing-unit connector means at the takedown pin 6 (see FIG. 1), and a magazine well 12 which includes a spring reception recess 14. The lower receiver frame member 68 further includes a set screw reception channel 26 in a wall of the magazine well 12, and further includes a magazine housing set screw 16 received in the set screw reception channel 26.

A spring-loaded magazine assembly 56 is received in the magazine well 12 and the spring reception recess 14. The spring-loaded magazine assembly 56 includes a cartridge magazine spring 18, a cartridge magazine follower 20, and a magazine housing or magazine top 22. The magazine housing 22 is preferably comprised of stamped sheet metal. However, in alternate embodiments, any suitable material or method for manufacturing the magazine housing 22 could be provided.

The magazine housing 22 comprises a substantially open bottom end, and a top end having an aperture for loading and dispensing cartridges. The top end comprises inwardly projecting cartridge retaining ears and cartridge feeding lips substantially identical to those shown in the alternate embodiment of FIGS. 8–12. The magazine housing 22 is received into the magazine well 12 with lateral sides of the magazine housing 22 extending downward along substantially the entire height of the magazine well 12 and located along inner lateral side walls of, the magazine well 12. In a preferred embodiment, the lateral side walls of the magazine housing 22 comprise inwardly projecting ridges to help prevent the magazine follower 20 and cartridges from becoming jammed inside the magazine housing 22 as the magazine follower 20 moves up and down along the inside of the magazine housing 22.

The magazine spring 18 is received in magazine well 12 and extends into the spring reception recess 14. The bottom end of the magazine spring 18 is located directly against the top surface of the bottom end 70 of the magazine well 12.

The cartridge magazine follower 20 is located inside the magazine housing 22 above the magazine spring 18. The cartridge magazine follower 20 is biased in an upward direction by the magazine spring 18. Cartridges contained in the magazine housing 22 are pushed up by the magazine follower 20 by the biasing force provided by the magazine spring 18 beneath the magazine follower 20.

The magazine housing 22 preferably has a maximum capacity of ten cartridges or less. As seen best in FIG. 3, the magazine housing 22 includes a set screw reception well 24 for receiving the magazine housing set screw 16 for securing the spring-loaded magazine assembly 56 in the magazine well 12.

Preferably, the first housing-to-firing-unit connector means include a first hinge portion formed in the lower receiver frame member 68, a second hinge portion formed in the firearm firing unit 11, and a hinge pin 52 received in the first hinge portion and the second hinge portion to form a hinged connection between the firearm firing unit 11 and the magazine receiver apparatus 10. The first hinge portion includes a front pivot pin reception channel 50.

Preferably, the second housing-to-firing-unit connector means include a first take first takedown pin reception channel 30 in the lower receiver frame member 68, a second takedown pin reception channel 31 in the firearm firing unit 11, and takedown pin 54 received in the first takedown pin reception channel 30 and the second takedown pin reception channel 31 for securing the lower receiver frame member 68 to the firearm firing unit 11. Preferably, the lower receiver frame member 68 includes a pin advancement well 28 surrounding one end of the first takedown pin reception channel 30.

The lower receiver frame member 68 further includes a stock-connector portion 58 for connecting to a firearm stock 13. Also, the lower receiver frame member 68 further includes a grip-connector portion 60 for connecting to a firearm pistol grip 15.

Preferably, the lower receiver frame member 68 further includes a self-contained takedown-pin-detent assembly for retaining the takedown pin 54 in the lower receiver frame member 68. Preferably, the takedown-pin-detent assembly includes a takedown pin detent assembly reception channel 32 extending from outside the lower receiver frame member 68 to the first takedown pin reception channel 30. A takedown pin detent set screw reception channel portion 34 is formed as of the first takedown pin reception channel 30, distal from the first takedown pin reception channel 30.

A takedown pin detent ball 36 is located inside the takedown pin detent assembly reception channel 32 adjacent to the first takedown pin reception channel 30. A takedown pin detent spring 38 is located in the takedown pin detent assembly reception channel 32 adjacent to the takedown pin detent ball 36. A takedown pin detent set screw 40 is received in the takedown pin detent set screw reception channel portion 34 adjacent to the takedown pin detent spring 38.

The presence of the takedown pin detent set screw reception channel portion 34 and the takedown pin detent set screw 40 retain the takedown pin detent ball 36 and the takedown pin detent spring 38 inside the lower receiver frame member 68 without any cooperation from the firearm stock 13. In this respect, the takedown-pin-detent assembly is self-contained in the lower receiver frame member 68. This is in contrast with a conventional arrangement in which a firearm stock retains a takedown pin detent ball 36 and a takedown pin detent spring 38 in a takedown pin detent assembly reception channel 32.

In addition, the takedown pin detent set screw 40 controls tension of the takedown pin detent spring 38 and the takedown pin detent ball 36 on the takedown pin 54 for controlling the force needed to remove the takedown pin 54 from the first takedown pin reception channel 30.

Preferably, the lower receiver frame member 68 further includes a self-contained safety switch detent assembly for retaining a safety switch assembly in the lower receiver frame member 68. The safety switch detent assembly includes a safety switch detent assembly reception channel 62 extending from outside the lower receiver frame member 68 to contacted portion of a safety switch assembly. A safety detent assembly reception channel 42 formed as part of the safety switch detent assembly reception channel 62, distal from the contacted portion of the safety switch assembly. A safety detent ball 44 located inside the safety switch detent assembly reception channel 62 adjacent to the contacted portion of the safety switch detent assembly. A safety detent spring 46 located in the safety switch reception channel 62 adjacent to the safety ball 44, and a safety detent set screw 48 received in the safety detent assembly reception channel 42 adjacent to the safety detent spring 46.

The presence of the safety detent assembly reception channel 42 and the safety detent screw 48 retain the safety detent ball 44 and the safety detent spring 46 inside the lower receiver frame member 68 without any cooperation from the firearm pistol grip 15. In this respect, the safety switch detent assembly is self-contained in the lower receiver frame member 68. This is in contrast with a conventional arrangement in which a firearm pistol grip retains a safety detent ball 44 and a safety detent spring 46 in a conventional safety switch detent assembly reception channel.

In addition, the safety detent set screw 48 controls tension of the safety detent spring 46 and the safety detent ball 44 on the contacted portion of the safety switch assembly for controlling stability of the safety switch assembly.

Although the magazine receiver apparatus 10 of the invention can be used in a wide variety of environments for a wide variety of firearms, an especially preferred magazine receiver apparatus 10 is fashioned in accordance with the principles of the present invention from a conventional U.S. Government issue type GI 7075 forging that it is conventionally manufactured for M-16 rifles. The magazine receiver apparatus 10 of the invention can be called a California Legal FAB 10 Lower Receiver.

The lower receiver frame member 4 is preferably comprised of forged aluminum. However, in alternate embodiments, any suitable material could be used. After the lower receiver frame member is initially forged, it is machined to form the magazine well 12 and other features. The lower receiver frame member 68 is, thus, a one-piece member formed as a unitary structure. However, in alternate embodiments, the lower receiver frame member could be comprised of multiple components connected to each other. In an alternate embodiment the lower receiver frame member could be cast rather than forged.

Unlike a conventional M-16 style of firearm configuration, the lower receiver frame member 68 of the present invention comprises a closed bottom end 70 at the bottom of the magazine well 12. In an alternate embodiment, the bottom end 70 might comprise a small hole, such as for drainage or preventing a vacuum from being formed inside the magazine well 12. The substantially closed bottom end 70 is preferably formed unitarily with the rest of the lower receiver frame member 68 during the forging process or casting process. The closed bottom end 70 prevents loading a magazine or loading cartridges through the bottom end.

Figure 2:
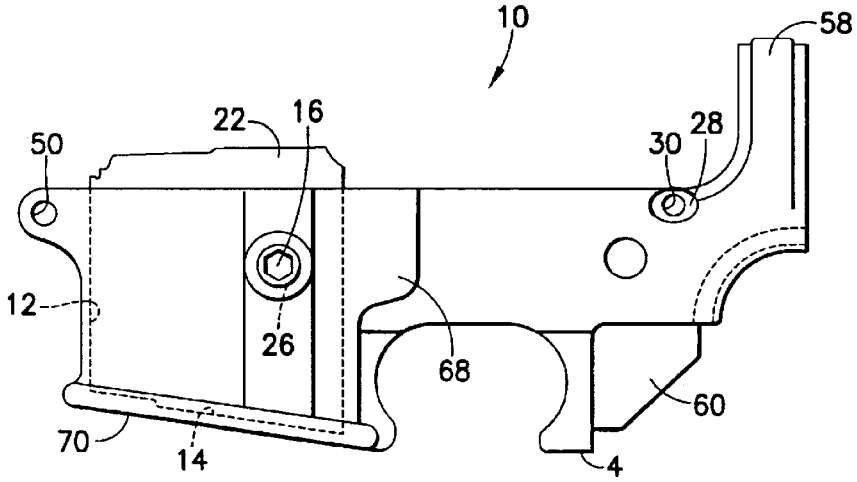
FIG. 2 is an enlarged side view of the embodiment of the firearm magazine receiver apparatus shown in FIG. 1, detached from the firing unit, the stock, and the pistol grip.
Figure 3:
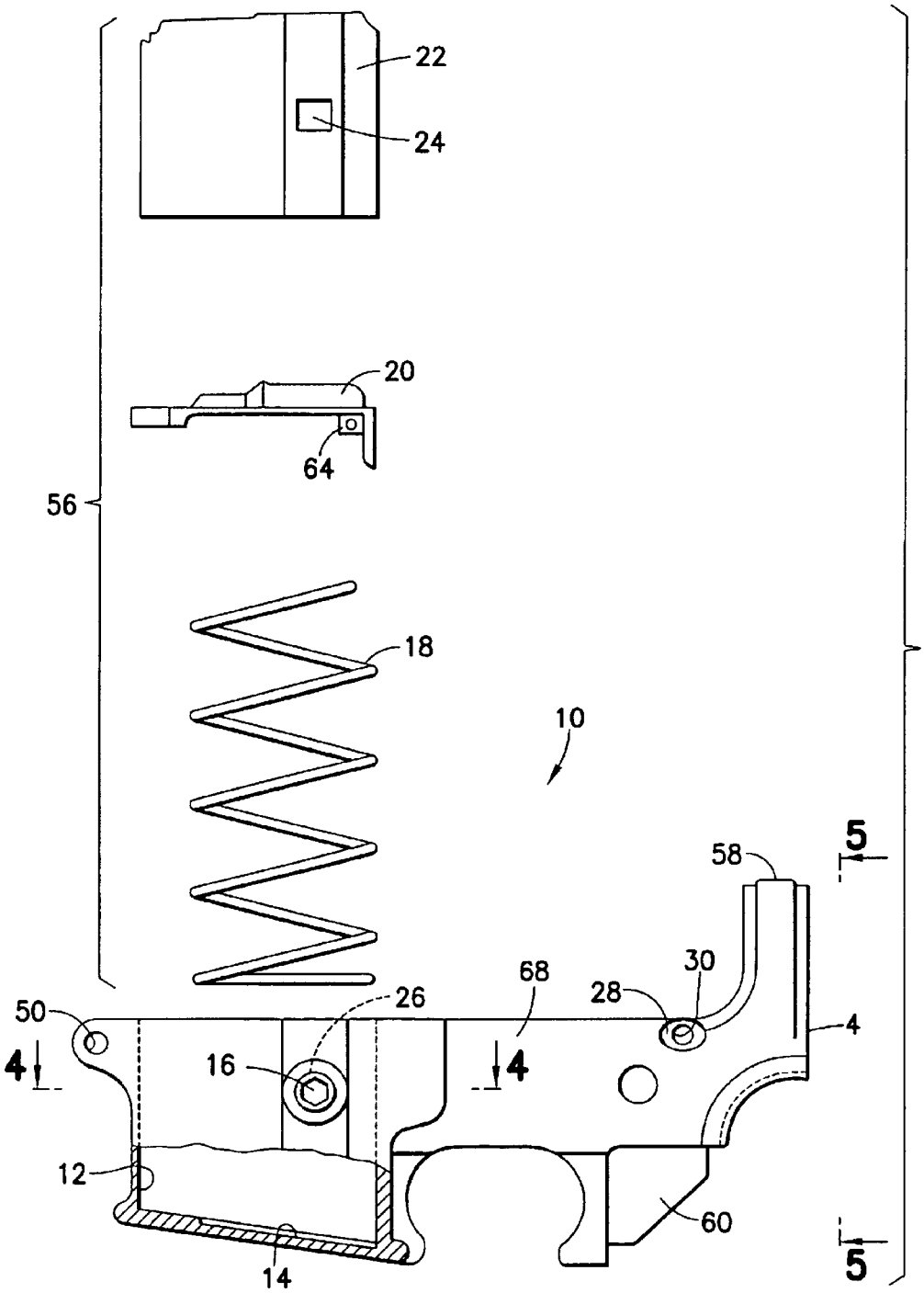
FIG. 3 is a partially exploded side view of the embodiment of the invention shown in FIG. 2.
Figure 4:
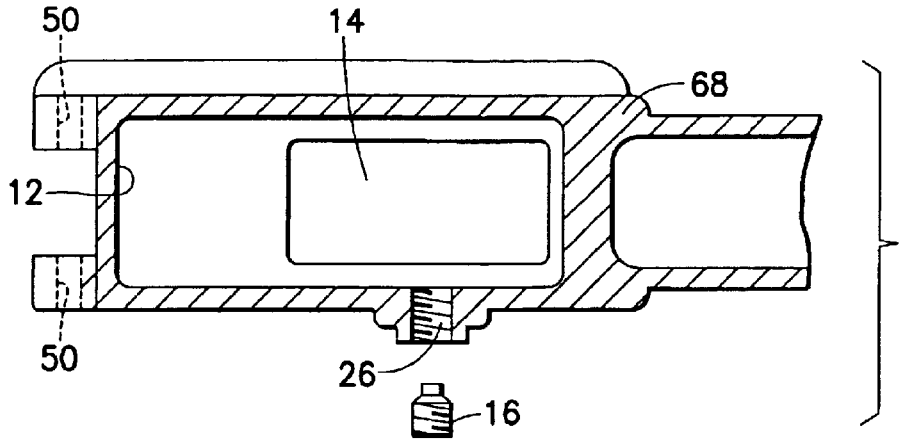
FIG. 4 is a partial cross-sectional view of the embodiment of the invention shown in FIG. 3 taken along line 4—4 thereof.
Figure 5:
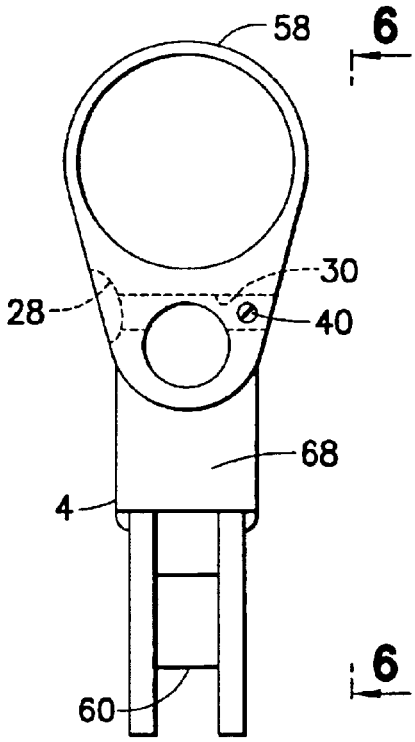
FIG. 5 is a rear end view of the embodiment of the invention shown in FIG. 3 taken along line 5—5 thereof.
Figure 6:
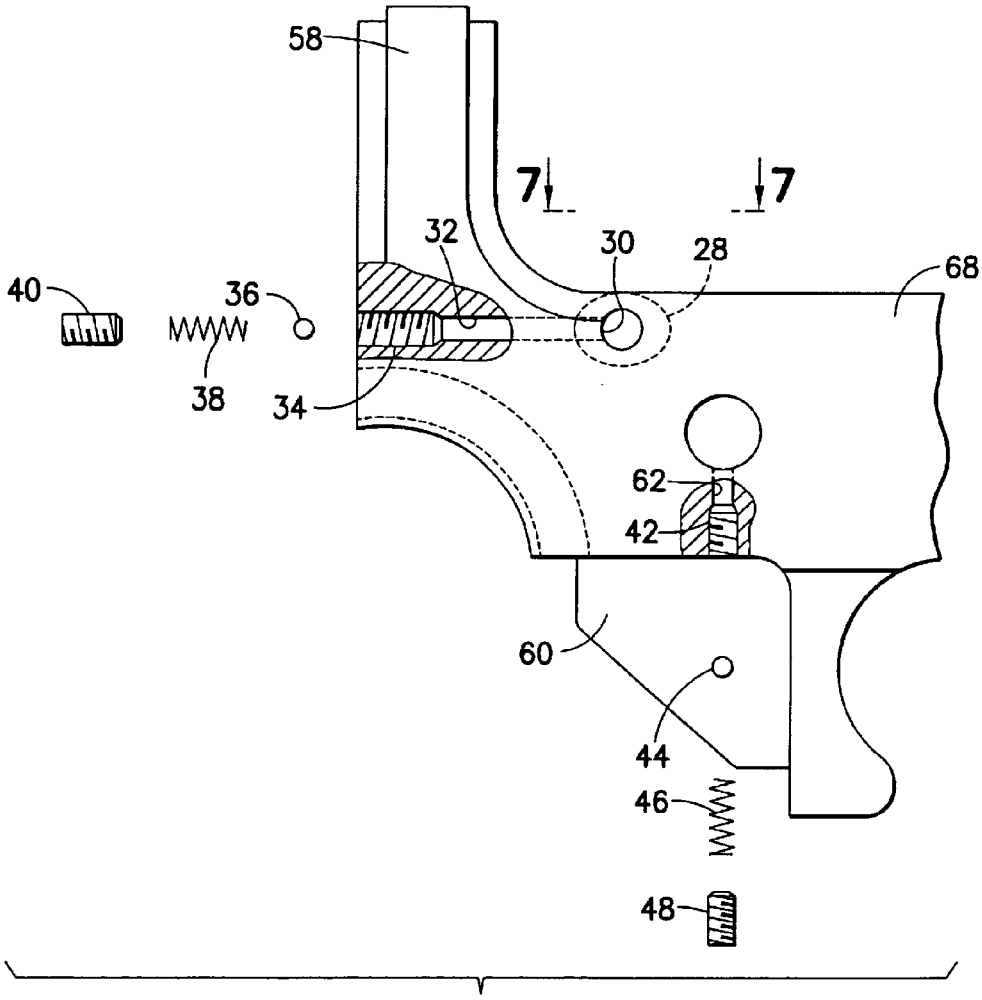
FIG. 6 is an enlarged partial side view of the embodiment of the invention shown in FIG. 5 and taken along line 6—6 thereof.
Figure 7:
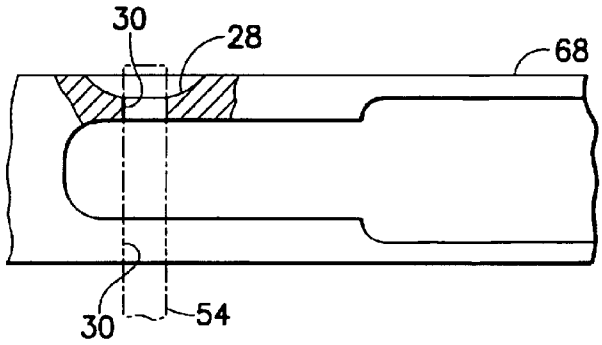
FIG. 7 is an enlarged partial top view of the embodiment of the invention shown in FIG. 6 taken along line 7—7 thereof.
Figure 8:
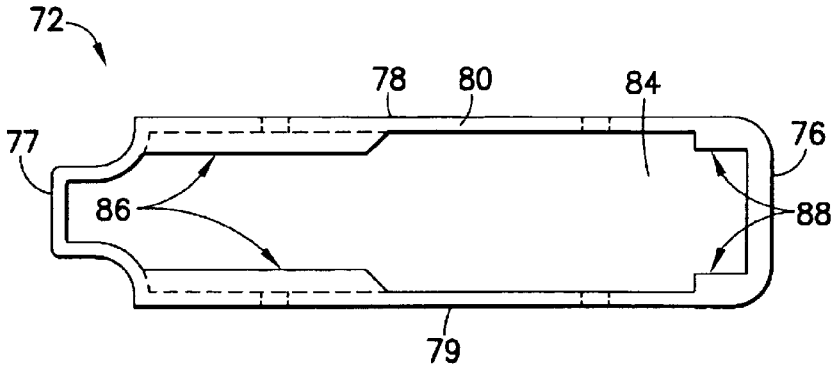
FIG. 8 is a top plan view of an alternate embodiment of a cartridge magazine top incorporating features of the present invention.
Figure 9:
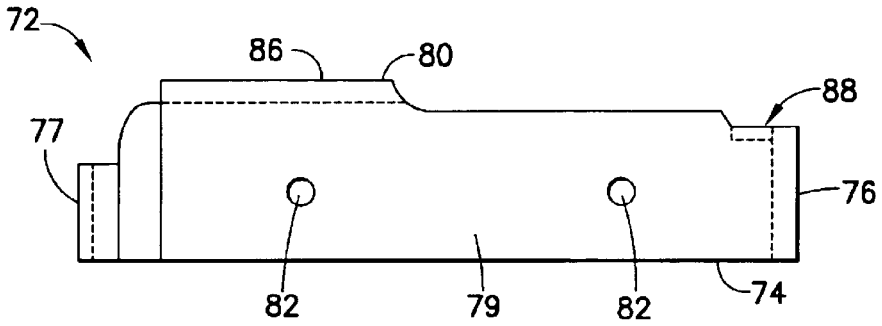
FIG. 9 is a lateral side elevational view of the cartridge magazine top shown in FIG. 8.
Figure 10:
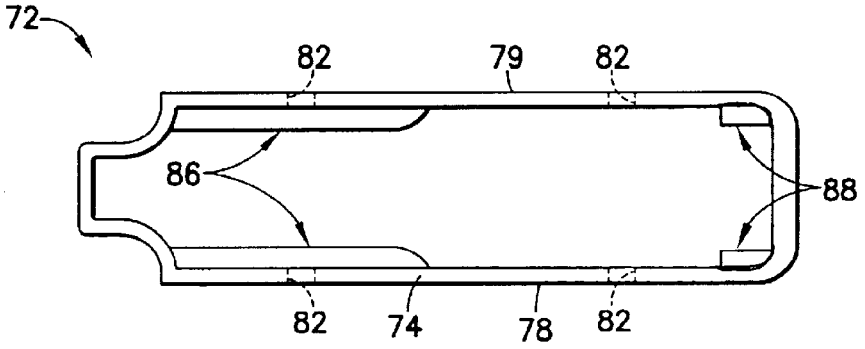
FIG. 10 is a bottom plan view of the cartridge magazine top shown in FIG. 8.
Figure 11:
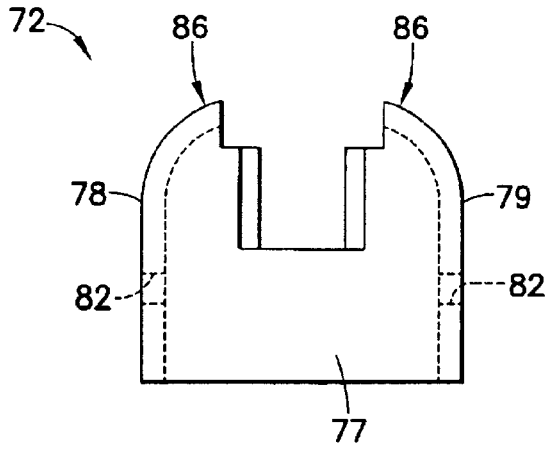
FIG. 11 is a rear side elevational view of the cartridge magazine top shown in FIG. 8.
Figure 12:
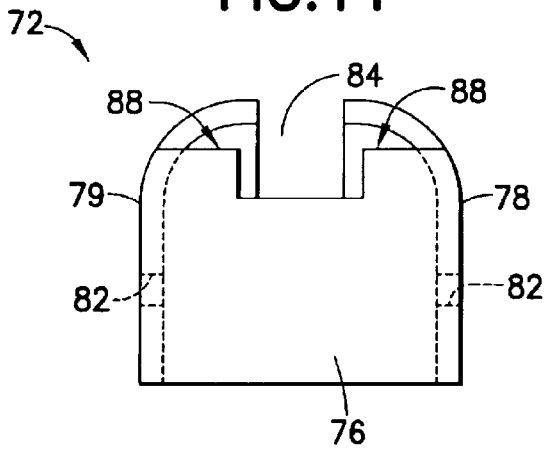
FIG. 12 is a front side elevational view of the cartridge magazine top shown in FIG. 8.
Figure 13:
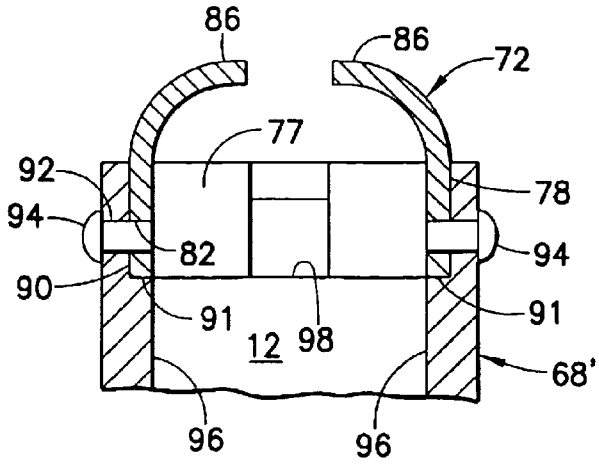
FIG. 13 is a cross sectional view of the cartridge magazine top shown in FIGS. 8–12 shown attached to a top side of a lower receiver frame member at a cartridge magazine well.

To install the spring-loaded magazine assembly 56 into the magazine well 12 in the lower receiver frame member 68, the bottom of the magazine spring 18 is placed in the spring reception recess 14 which is in the floor of the magazine well 12. As shown in FIGS. 2, 3, and 4, the spring reception recess 14 provides a lower bottom surface which is lower than the remainder of the floor of the magazine well 12.

The length and width dimensions of the spring reception recess 14 are provided to accept the bottom of the magazine spring 18 so that the magazine spring 18 fits closely with the walls of the spring reception recess 14.

In this way, the spring reception recess 14 prevents the magazine spring 18 from sliding along the bottom of the magazine well 12. A top end of the magazine spring 18 fits into a spring-end-reception channel 64 in the magazine follower 20. The magazine follower 20 fits into the bottom opening in the magazine housing 22 and rides inside the magazine housing 22 as cartridges are placed in the magazine housing 22 and as cartridges are removed from the magazine housing 22.

The spring-loaded magazine assembly 56 is locked into the magazine well 12 in the following way. The magazine housing 22 is pushed down into the magazine well 12, overcoming the resistant force in the magazine spring 18, so the set screw reception well 24 in the magazine housing 22 is placed in registration with the magazine housing set screw, 16. When the magazine housing set screw 16 is sufficiently screwed into the set screw reception channel 26, a free end of the magazine housing set screw 16 is tightened into the set screw reception well 24.

When the magazine housing set screw 16 is tightened into the set screw reception well 24, the magazine housing 22 is prevented from moving when inside the magazine well 12. The fixed positioning of the magazine housing 22 in the magazine well 12, also keeps the magazine spring 18, the magazine follower 20, and the magazine housing 22 in proper alignment inside the magazine well 12. In an alternate embodiment, any suitable means could be used to removably connect the magazine housing 22 in the magazine well 12. In another alternate embodiment, the connection of the magazine housing 22 to the lower receiver frame member 68 might not comprise a removable connection. The connection could be a stationary fixed and permanent connection, such as a rivet or a weld.

As shown in FIG. 1, the magazine receiver apparatus 10 is connected to the firearm firing unit 11 using the hinge pin 52, the front pivot pin reception channel 50 on the magazine receiver apparatus 10, and the second hinge portion on the firearm firing unit 11. To load and unload the magazine receiver apparatus 10 of the invention, as shown in FIG. 1, the takedown pin 54 has been moved from the first takedown pin reception channel 30 and the second takedown pin reception channel 31 so that the firearm firing unit 11 is swung around the hinge pin 52, and the spring-loaded magazine assembly 56 is accessible from above the lower receiver frame member 68.

Once the upper receiver is pivoted open relative to the lower receiver, the top side of the lower receiver is now open for access to the user. The user can load new cartridges into the magazine assembly 56 by pressing the cartridges into the magazine housing 22 through the open aperture at the top of the magazine housing, 22. Unless the upper receiver is moved to the open position relative to the lower receiver, similar to that shown in FIG. 1, new cartridges cannot be loaded into the magazine assembly 56. A stripper clip guide (not shown) can also be attached to the top of the magazine housing 22, and the new cartridges can then be inserted into the magazine housing 22.

When a new supply of cartridges has been added to the magazine housing 22, the magazine follower 20 is pushed downward to overcome the upward force of the magazine spring 18. The firearm firing unit 11 is then swung around the hinge pin 52 to close the firearm firing unit 11 on the magazine receiver apparatus 10. When the firearm firing unit 11 is closed on the magazine receiver apparatus 10, the first takedown pin reception channel 30 in the lower receiver frame member 68 and the second takedown pin reception channel 31 in the firearm firing unit 11 are placed in the registration, and the takedown pin 54 is passed through the registered first takedown pin reception channel 30 and the second takedown pin reception channel 31. In this way, the firearm firing unit 11 is locked in the closed position with respect to the magazine receiver apparatus 10.

The pin advancement well 28 at one end of the first takedown pin reception channel 30 permits a person to push one's finger into the pin advancement well 28 and push the takedown pin 54 partially out of the first takedown pin reception channel 30 so that the person can easily grab the opposite end of the takedown pin 54 for pulling the takedown pin 54 out from the first takedown pin reception channel 30.

As explained above, force on the takedown pin 54 is controlled by screwing the takedown pin detent set screw 40 into the takedown pin detent set screw reception channel portion 34 to push the takedown pin detent spring 38 against the takedown pin detent ball 36 which rests on the takedown pin 54. Similarly, as explained above, tension and stabilizing forces on the contacted portion of the safety switch assembly by the safety detent ball 44 and the safety detent spring 46 is controlled by the setting of the safety detent set screw 48.

To remove the spring-loaded magazine assembly 56 from the magazine well 12, such as for cleaning, the magazine housing set screw 16 can be screwed out from the set screw reception well 24, and the magazine spring 18 is permitted to expand upward to push the magazine follower 20 upward, and the magazine housing 22 can be lifted upward. The components of the firearm magazine receiver apparatus of the invention can be made from inexpensive and durable metal and plastic materials.

One type of alternate embodiment to the embodiment described above could comprise the magazine housing 22 having a substantially closed bottom, and wherein the magazine spring 18 would be wholly contained within the magazine housing 22. In other words, the magazine assembly would be a unitary structure which could be loaded and unloaded from the lower receiver 4 as a unitary structure. However, because of the substantially closed bottom end 70 of the magazine well 12, the magazine assembly would need to be loaded into the magazine well 12 through the open top end of the magazine well 12. Thus, the upper receiver 3 would still need to be pivoted open relative to the lower receiver 4 before a new magazine assembly could be loaded into the magazine well 12.

With the present invention, a major modification is provided for illegal assault weapons so that the modified assault weapons are legal. One aspect of the subject modified firearm that renders it legal is providing a magazine clip that contains ten or less cartridges. Another aspect of the subject modified firearm that renders it legal is requiring that the firearm undergo a partial disassembly to load new cartridges into the internal cartridge magazine, or alternatively, remove a spent cartridge magazine and to replace the spent magazine with a full magazine. That is, the magazine clip with the present invention is not readily detachable. Still another aspect of the subject modified assault weapon is that it requires that the loading of new cartridges, or alternatively removal and replacement of a magazine, be done from above the weapon.

Referring now also to FIGS. 8–14, an alternate embodiment of the present invention will be described. In this embodiment the magazine assembly comprises a cartridge magazine top 72, and the magazine follower 20 and magazine spring 18 shown in FIG. 3. The magazine top 72 is preferably comprised of stamped sheet metal. However, in alternate embodiments, the magazine top 72 could be comprised of any suitable material, and could be manufactured by any suitable manufacturing process. The magazine top 72 generally comprises a bottom side 74, sidewalls 76, 77, 78, 79, and a top side 80.

The bottom side 74 is substantially open. The two lateral side walls 78, 79 comprise fastener holes 82 therethrough. The holes 82 are threaded to have fasteners threaded into the holes 82. The top side 80 comprises an aperture 84 therethrough. The top side 80 also comprises inwardly projecting cartridge retaining ears 86 and cartridge feeding lips 88. The top side 80 preferably comprises a configuration similar to a cartridge magazine for an M-16 style of firearm. The cartridge retaining ears 86 are adapted to engage the rear end of a cartridge to retain the cartridge inside the magazine top 72 below the cartridge retaining ears 86, at least until the cartridge is pushed forward out of the magazine top by the bolt of the firearm. The cartridge feeding lips 88 are adapted to help guide the front of the cartridge out of the aperture 84.

Figure 14:
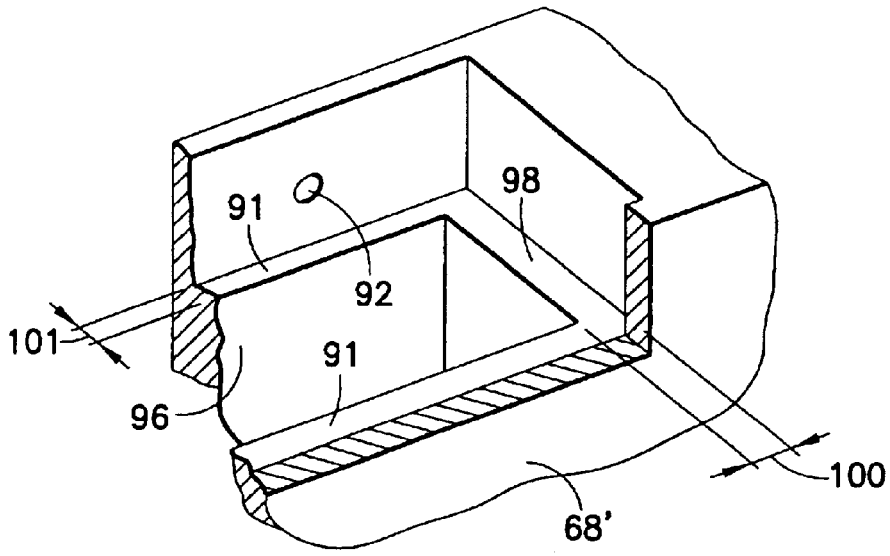
FIG. 14 is a partial perspective view with a cut away section of the top end of the lower receiver frame member shown in FIG. 13 showing one end of the magazine well with the magazine top removed.

The lower receiver frame member 68' has been machined to form recesses 90 at the inner lateral sides of the lower receiver frame member 68' at the magazine well 12 to form inner ledges 91. The lower receiver frame member 68' also comprises the fastener receiving holes 92. The sidewalls 76–79 of the magazine top 72 are sized and shaped to fit into the receiving area formed by the recesses 90 at the top of the magazine well 12. Referring also to FIG. 14, the lower receiver frame member 68' has transverse ledges 98 (only one of which is shown) at the front and rear top sides of the magazine well 12. The front side wall 76 and the rear side wall 77 rest on the transverse ledges 98 in the lower receiver frame member 68', and the lateral side walls 78, 79 can be positioned on the ledges 91 along the interior lateral sides of the lower receiver frame member 68'. The flush inner sides of the sides 76–79 with the walls 96 at their joints help to prevent interference with feeding of the cartridges up and down in the magazine well.

The thicknesses 100, 101 of the ledges 91,98 can be substantially the same thickness as the walls of the magazine top such that the inside surfaces of the front and rear walls 76, 77 can be flush with the front and rear walls of the magazine well 12. This also allows the inside surfaces of the side walls 78, 79 to be flush with the inside surfaces of the side walls 96 of the magazine well 12. Because the magazine top 72 does not need to extend into the magazine well 12 along the inner side walls 96, the height of the lateral side walls 78, 79 can be substantially smaller then the height of the magazine well 12. This type of configuration allows the side walls 96 to be thicker than in the prior art in order to give added strength. Alternatively, the side walls 96 could be thinner than a conventional firearm to reduce the weight of the firearm while maintaining the same strength as in a conventional firearm.

The holes 82 and 92 are aligned with each other. Fasteners 94 are located in the holes 82, 92 to fixedly and stationarily attach the magazine top 72 to the lower receiver frame member 68'. In a preferred embodiment, the fasteners 94 comprise screws. However, in alternate embodiments, any suitable type of fastener could be used, such as a weld or a rivet. When the fasteners 94 are attached, portions of the magazine top 72 are clamped against the inwardly facing surfaces of the lower receiver frame member 68' in the top of the magazine well.

The cartridges are received in the magazine well 12 directly against the inner side walls 96 of the magazine well of the lower receiver frame member 68'. The magazine follower 20 slides along the inner side walls 96. The lower receiver frame member 68' would still comprise a substantially closed bottom end to the magazine well 12 for the magazine spring 18 to rest against. With this embodiment, similar to the first embodiment described above, the upper receiver 3 would need to be opened relative to the lower receiver 4 in order for cartridges to be loaded through the magazine top 72 and into the magazine well 12. Thus, the firearm 1 would need to be partially disassembled in order to load the magazine assembly with new cartridges.

The present invention can provide a firearm having an M-16 style configuration which comprises an internal, not readily detachable, cartridge magazine which requires a partial disassembly of the firearm to load.

Figure 15:
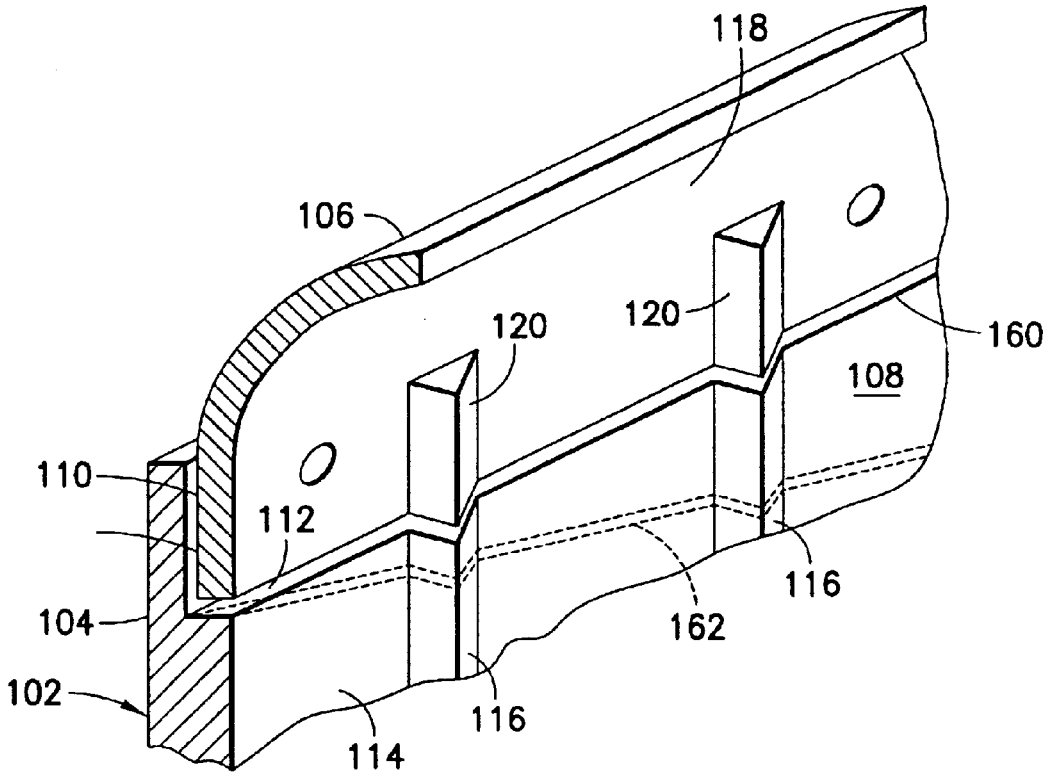
FIG. 15 is a partial perspective view with a cut away section of an alternate embodiment of the lower receiver one piece frame member and magazine top incorporating features of the present invention.

Referring now also to FIG. 15, there is shown a partial perspective view with a cutaway section of an alternate embodiment of the present invention. In this embodiment the lower receiver 102 comprises a one-piece frame member 104 and a magazine top 106. The frame member 104 comprises a magazine well 108. A top of the magazine well 108 comprises a recess 110 with a top facing ledge 112. The frame member 104 is preferably comprised of forged metal or cast metal, such as aluminum or steel. The frame piece 104 comprises inward facing lateral side walls 114 in the magazine well 108. In this embodiment, the sidewalls 114 comprises inwardly projecting ridges 116. The magazine follower (not shown) would comprise mating recesses to receive the ridges 116. The ridges 116 provide a reduced surface area for contact with the sides of the cartridges (not shown) to reduce frictional drag on the cartridges as they are moved upward in the magazine well 108.

The magazine top 106 is substantially identical to the magazine top 72 shown in FIGS. 8–13. However, in this embodiment the inward facing surfaces of the lateral sides 118 of the magazine top 106 comprise inwardly projecting ridges 120. The ridges 120 comprises a substantially same inward projecting profile as the ridges 116. When the magazine top 106 is attached to the frame member 104 in the recess 110, the ridges 120 align with the ridges 116. Thus, the ridges 120 of the magazine top 106 continue the guiding and reduced friction function provided by the ridges 116 of the frame member 104 above the ledge 112.

Figure 16:
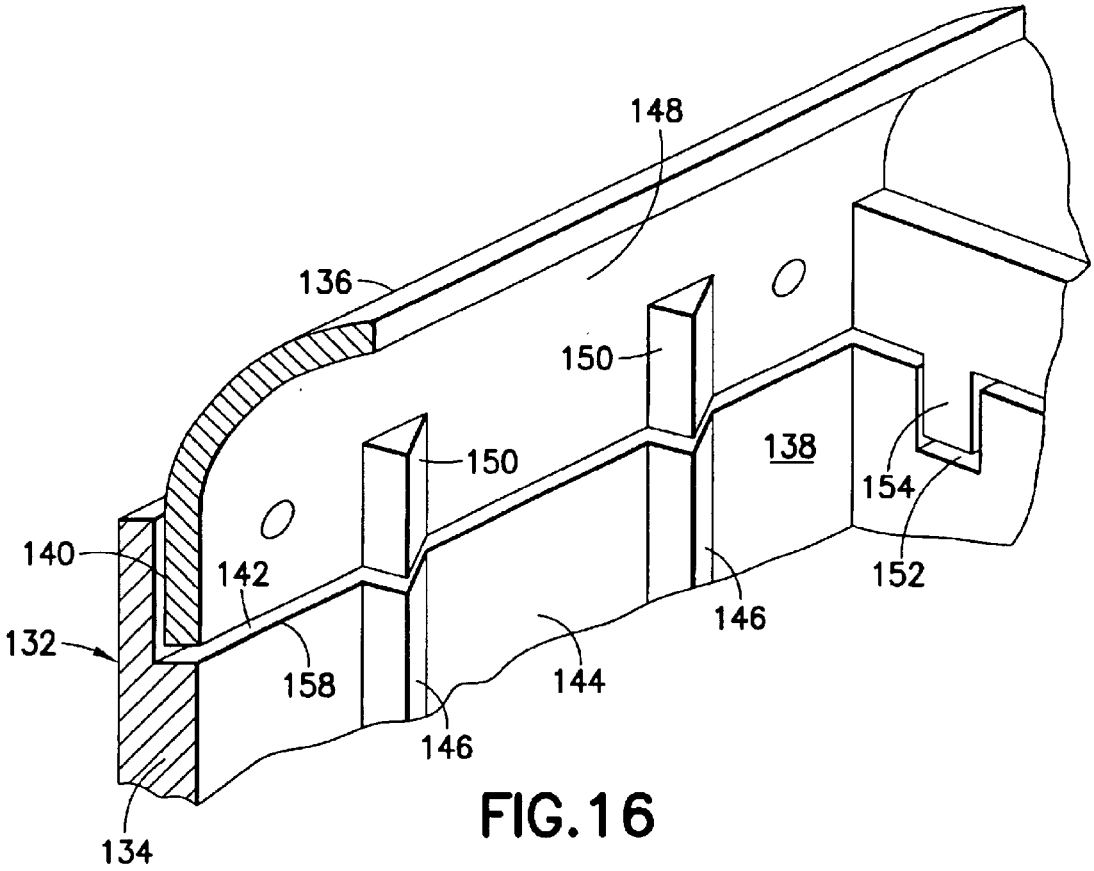
FIG. 16 is a partial perspective view with a cut away section of another alternate embodiment of the lower receiver one piece frame member and magazine top incorporating features of the present invention.

Referring now also to FIG. 16, a partial perspective view with a cutaway section of another alternate embodiment is shown. In this embodiment the lower receiver 132 comprises a one-piece frame member 134 and a magazine top 136. The frame member 134 comprises a magazine well 138. A top of the magazine well 138 comprises a recess 140 with a top facing ledge 142. The frame member 134 is preferably comprised of forged metal or cast metal, such as aluminum or steel. The frame piece 134 comprises inward facing lateral side walls 144 in the magazine well 138. In this embodiment, the sidewalls 144 comprises inwardly projecting ridges 146. The magazine follower (not shown) would comprise mating recesses to receive the ridges 146. The ridges 146 provide a reduced surface area for contact with the sides of the cartridges (not shown) to reduce frictional drag on the cartridges as they are moved upward in the magazine well 138.

The magazine top 136 is substantially identical to the magazine top 106 shown in FIG. 16. The inward facing surfaces of the lateral sides 148 of the magazine top 136 comprise inwardly projecting ridges 150. The ridges 150 comprises a substantially same inward projecting profile as the ridges 146. When the magazine top 136 is attached to the frame member 134 in the magazine well 138, the ridges 150 align with the ridges 146. Thus, the magazine top 136 continues the guiding and reduced friction function provided by the ridges 146 of the frame member 134.

Figure 17:
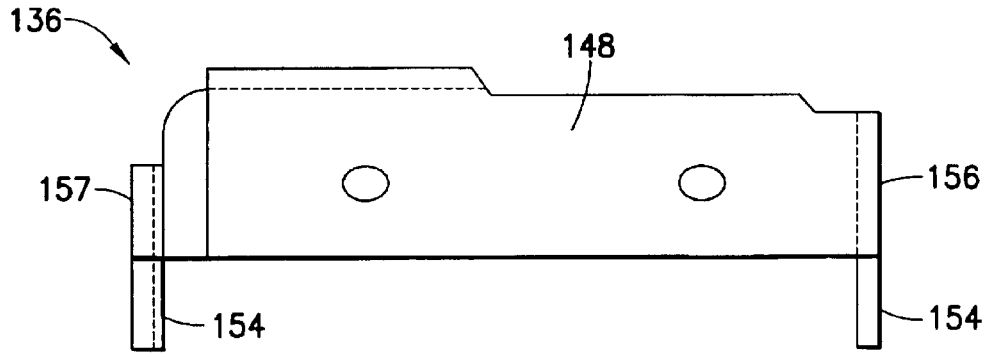
FIG. 17 is a side elevational view of the magazine top shown in FIG. 16.

In this embodiment, the frame member 134 also comprises downward extending recesses 152 (only one of which is shown) at the front and rear sides of the magazine well 138. Referring also to FIG. 17, the magazine top 136 includes downwardly extending projections 154 at its front and rear sides 156, 157. Thus, the bottom of the magazine top 136 can comprise different height sections. The projections 154 are adapted to sit in the recesses 152. The recesses 152 are adapted to function as keyways for the projections 154. The projections 154 and recesses 152 can provide an interference fit between the magazine top 136 and the frame member 134. The projections 154 and recesses 152 can be used to align the fit of the magazine top 136 to the frame member 134 to help minimize interference or hang-ups by the spring and follower as they pass by the joint 158 between the magazine top 136 and frame member 134. The alignment feature of the projections 154 and recesses 152 also allows for relatively precise repositioning of the magazine top 136 by a user in the event the magazine top 136 is removed and re-attached, with such as for cleaning.

Referring back to FIG. 15, the joint 160 between the magazine top 106 and the one piece frame member 104 is shown as a substantially straight horizontal line. However, in an alternate embodiment, the joint between the magazine top and the one piece frame member of the lower receiver could comprise an angled joint 162 as illustrated by the dotted line in FIG. 15. In addition, although the ridges 116, 120 are shown as straight vertical guides, the ridges could comprise any suitable shape, such as being angled or having a curved or serpentine design. This non-straight shape could help to reduce the possibility of the cartridges, follower or spring hanging up on the sides of the magazine well.

The foregoing detailed description is considered as illustrative only of the principles of the invention. Numerous modifications and changes will readily occur to those skilled in the art and therefore, it is not desired to limit the invention to the exact construction an operation shown and described. Accordingly, all suitable modifications and equivalents falling within the broad scope of the subject matter described above may be restored to in carrying out the present invention.

What is claimed is:

1. A firearm comprising:

a barrel;

an upper receiver, the upper receiver having the barrel attached thereto;

a lower receiver pivotably attached to the upper receiver, wherein the lower receiver comprises a one piece frame member forming a magazine well with an integral substantially closed bottom end;

a magazine top stationarily attached to the lower receiver, the magazine top comprising inward projecting rear cartridge retaining ears and front cartridge feeding lips at a top aperture through the magazine top;

a magazine follower movably located in the magazine well of the lower receiver; and a spring located between the closed bottom end of the magazine well and the magazine follower.

2. A firearm as in claim 1 wherein the one piece frame member of the lower receiver comprises an aluminum forging.

3. A firearm as in claim 1 wherein the one piece frame member further comprises a stock connector portion and a grip connector portion.

4. A firearm as in claim 1 wherein the one piece frame member of the lower receiver comprises a front pivot connection area having a front pivot pin reception channel for pivotably attaching the upper receiver to the lower receiver, and a take down pin reception channel proximate a rear of the one piece frame member.

5. A firearm as in claim 1 wherein the magazine top comprises a one-piece metal stamped member.

6. A firearm as in claim 1 wherein the magazine top comprises side walls which extend into the magazine well.

7. A firearm as in claim 1 wherein the magazine top is attached to the one-piece frame member by a removable fastener.

8. A firearm as in claim 1 wherein the magazine top is attached to the one piece frame member by a permanent fixed connection.

9. A firearm as in claim 1 wherein the magazine top is attached to the one piece frame member by a plurality of fasteners extending inwardly at lateral sides of the magazine well.

10. A firearm as in claim 9 wherein portions of the magazine top are pulled by the fasteners against an inwardly facing surface of the one piece frame member.

11. A firearm as in claim 1 wherein the magazine top comprises a substantially open bottom end.

12. A firearm as in claim 1 wherein the lower receiver comprises a takedown pin detent set screw reception channel portion and the takedown pin detent set screw retaining a takedown pin detent ball and a takedown pin detent spring in the one piece frame member.

13. A firearm as in claim 1 wherein the lower receiver comprises a safety detent assembly reception channel and the safety detent screw retaining a safety detent ball and the safety detent spring in the one piece frame member.

14. A firearm as in claim 1 wherein the upper receiver comprises a cartridge entrance aperture through the upper receiver for loading cartridges through the upper receiver into the magazine well.

15. A method of manufacturing a firearm subassembly comprising steps of:

forming a one-piece firearm lower receiver frame member by forging or casting the frame member and machining the frame member to form a magazine well with a substantially closed bottom end, wherein the lower receiver frame member is sized and shaped to be pivotably connected to a firearm upper receiver;

inserting a magazine spring and a magazine follower into the magazine well of the lower receiver frame member; and stationarily attaching a magazine top to the lower receiver frame member to at least partially cover a top cartridge entrance/exit to the magazine well at an upper side of the lower receiver frame member, the magazine top comprising rear cartridge retaining ears and front cartridge feeding lips, such that cartridges can only be loaded into the magazine well of the lower receiver frame member by pressing the cartridges through the top of the magazine well at the upper side of the lower receiver frame member through the magazine top.

16. A method as in claim 15 wherein the step of inserting a magazine spring into the magazine well of the lower receiver frame member comprises the magazine spring being located against a top surface of the substantially closed bottom end of the magazine well.

17. A method as in claim 15 wherein the step of forming the one-piece firearm lower receiver frame member comprises forming a front pivot connection area having a front pivot pin reception channel for pivotably attaching the upper receiver to the lower receiver, and a take down pin reception channel proximate a rear of the one piece frame member.

18. A method as in claim 15 wherein the step of attaching the magazine top to the lower receiver frame member comprises inserting front and rear end walls of the magazine top into the magazine well of the lower receiver frame member and fixedly attaching lateral side walls of the magazine top to the lower receiver frame member by fasteners.

19. A method as in claim 15 wherein the step of attaching the magazine top to the lower receiver frame member comprises inserting a portion of the magazine top onto an inside ledge of the lower receiver frame member.

20. A method as in claim 15 wherein the step of attaching the magazine top to the lower receiver frame member comprises the magazine spring being located partially in the magazine top and extending out of a substantially open bottom end of the magazine top.

21. A firearm subassembly comprising:

a firearm receiver frame member having a magazine well;

a magazine top fixedly attached to the firearm receiver frame member at a top of the magazine well, the magazine top comprising rear cartridge retaining ears at a top aperture through the magazine top, wherein a bottom portion of the magazine top is located against an upwardly facing ledge inside a top portion of the magazine well; and a magazine follower and a magazine spring located in the magazine well below the magazine top.

22. A firearm subassembly as in claim 21 wherein the firearm receiver frame member comprises a one piece lower receiver frame member comprised of an aluminum forging.

23. A firearm subassembly as in claim 22 wherein the one piece frame member further comprises a stock connector portion and a grip connector portion.

24. A firearm subassembly as in claim 23 wherein the one piece frame member comprises a front pivot connection area having a front pivot pin reception channel for pivotably attaching an upper receiver to the lower receiver, and a take down pin reception channel proximate a rear of the one piece frame member.

25. A firearm subassembly as in claim 21 wherein the magazine top comprises a one-piece metal stamped member.

26. A firearm subassembly as in claim 21 wherein portions of the magazine top are pulled outward by fasteners against an inward facing surface of the firearm receiver frame member in the magazine well.

27. A firearm subassembly as in claim 26 wherein the magazine top and the firearm receiver frame member comprise inward projecting guides extending into the magazine well, and wherein the guides of the magazine top are vertically aligned with the guides of the firearm receiver frame member.

28. A firearm subassembly as in claim 21 wherein the magazine top comprises downwardly extending keyway projections at front and rear end walls which extend into downwardly extending keyway recesses in the firearm receive frame member.

* * * * *